US005941024A

United States Patent [19]

Journault

[11] Patent Number: 5,941,024

[45] Date of Patent: Aug. 24, 1999

[54] FLOOR HATCH WITH INTEGRATED SECURITY FENCE

[75] Inventor: Jules Journault, Verdun, Canada

[73] Assignee: Journault-Jourplex Inc., Verdun, Canada

[21] Appl. No.: 09/044,803

[22] Filed: Mar. 20, 1998

[51] Int. Cl.[6] ..... E02D 29/14

[52] U.S. Cl. ..... 52/20; 52/64; 49/33; 49/67; 182/112

[58] Field of Search ..... 52/19, 20, 64; 49/30, 107, 115, 118, 33, 67, 133; 160/40, 117; 182/113, 112; 256/13.1, 26

[56] References Cited

U.S. PATENT DOCUMENTS

| | | | |
|---|---|---|---|
| 4,090,585 | 5/1978 | Laub | 182/47 |
| 4,121,392 | 10/1978 | Plewacki | 52/64 |
| 4,150,510 | 4/1979 | Harrison et al. | 49/388 |
| 4,186,521 | 2/1980 | Hunter | 49/30 |
| 4,266,380 | 5/1981 | Samolis | 52/19 |
| 4,308,697 | 1/1982 | Guppy | 52/64 |
| 4,561,483 | 12/1985 | Calvert | 160/159 |
| 5,354,036 | 10/1994 | Brown | 256/25 |
| 5,419,537 | 5/1995 | Thompson | 256/17 |
| 5,546,703 | 8/1996 | Conway | 49/197 |
| 5,630,572 | 5/1997 | Guay | 256/1 |

*Primary Examiner*—Christopher T. Kent
*Assistant Examiner*—Yvonne Horton-Richardson
*Attorney, Agent, or Firm*—Robic

[57] ABSTRACT

A floor hatch with a built-in security fence is described, where access to the understructure can only be provided wherein a pair of doors are pivoted outwardly to an open position and secured, forming two opposite sides of the security fence; a first gate is pivoted outwardly to an open position and secured to each of the doors, forming the rear of the security fence and a second gate, leaving a pivoting door, is pivoted outwardly and secured to each of the doors forming the front of the security fence. The pivoting door of the second gate pivots outwardly to permit access to the opening in the floor. The floor hatch may also include a security grate and telescoping extension on each of the doors. The floor hatch can be locked in the closed position and can be opened, automatically forming a security fence, to permit access to an understructure of a floor.

15 Claims, 7 Drawing Sheets

FLOOR HATCH WITH INTEGRATED SECURITY FENCE

FIELD OF THE INVENTION

The present invention relates to a floor hatch with an integrated security fence.

BACKGROUND OF THE INVENTION

In industrial plants, office buildings and other such structures as well as on sidewalks or anywhere a floor has an understructure of any kind that requires access thereto, it is known to provide a floor hatch in order to access cables, ventilation equipment or other structures which may be present in the understructure of the floor.

Such floor hatches are usually comprised of an opening in the floor that is accessible through a door hinged to the opening. In order to prevent people falling through the hatch, it is known to provide a security system associated with the floor hatch. The security system usually entails building a security perimeter around the floor hatch that is made of posts interconnected with chains or a rigid frame around the hatch.

The above security system has the disadvantages of having to be stored somewhere when the hatch is not open. It is also time-consuming for a person to retrieve the security perimeter, install it around the floor hatch, disassemble it when the work is done and store it afterwards. In some cases, because of this disadvantage, people forget or omit to install the security perimeter altogether, which poses a serious security risk to other people in the vicinity of the floor hatch.

SUMMARY OF THE INVENTION

It is an object of the invention to provide a floor hatch with an integrated security fence that is automatically assembled when opening the floor hatch. In accordance with the invention, this object is achieved with a floor hatch with an integrated security fence, the floor hatch comprising:

a frame having a rectangular shape with a longitudinal axis, two opposite edges parallel to the axis, a front edge and a rear edge, the opposite edges, the front edge and the rear edge defining an opening having a length and a width, a top and a bottom, the opening lying in a plane parallel to a floor;

a pair of pivoting doors sized and shaped to at least cover the opening, the doors being mounted on hinges lying parallel to the axis along the opposite edges of the frame, the doors pivoting upwardly between a closed position where the doors are substantially parallel to the plane and block access to the opening and an open position where the doors are substantially perpendicular to the plane, forming opposite sides of said security fence;

means for retaining the doors in the open position; and a first gate pivotably mounted to the rear edge on hinges lying perpendicular to the axis, the first gate lying below the doors and having a width smaller than the width of the opening, the first gate being accessible when the doors are in the open position, the first gate pivoting upwardly between a closed position where the gate is substantially parallel to the plane and blocks access to the opening and an open position where the gate lies in a plane perpendicular to the plane and forms a rear side of the security fence, the first gate further having two opposite sides, each of the opposite sides being provided with means to secure the first gate in the open position to a corresponding one of the doors, whereby, when the first gate and the doors are in the closed position, access to the opening is denied, and when the doors are pivoted to the open position and, subsequently, when the first gate is pivoted to the open position, access to the opening is permitted only through the front edge of the frame.

BRIEF DESCRIPTION OF THE DRAWINGS

The present invention and its advantages will be more easily understood after reading the following non-restrictive description of a preferred embodiment thereof, made with reference to the following drawings in which.

DESCRIPTION OF A PREFERRED EMBODIMENT

Figure 1:
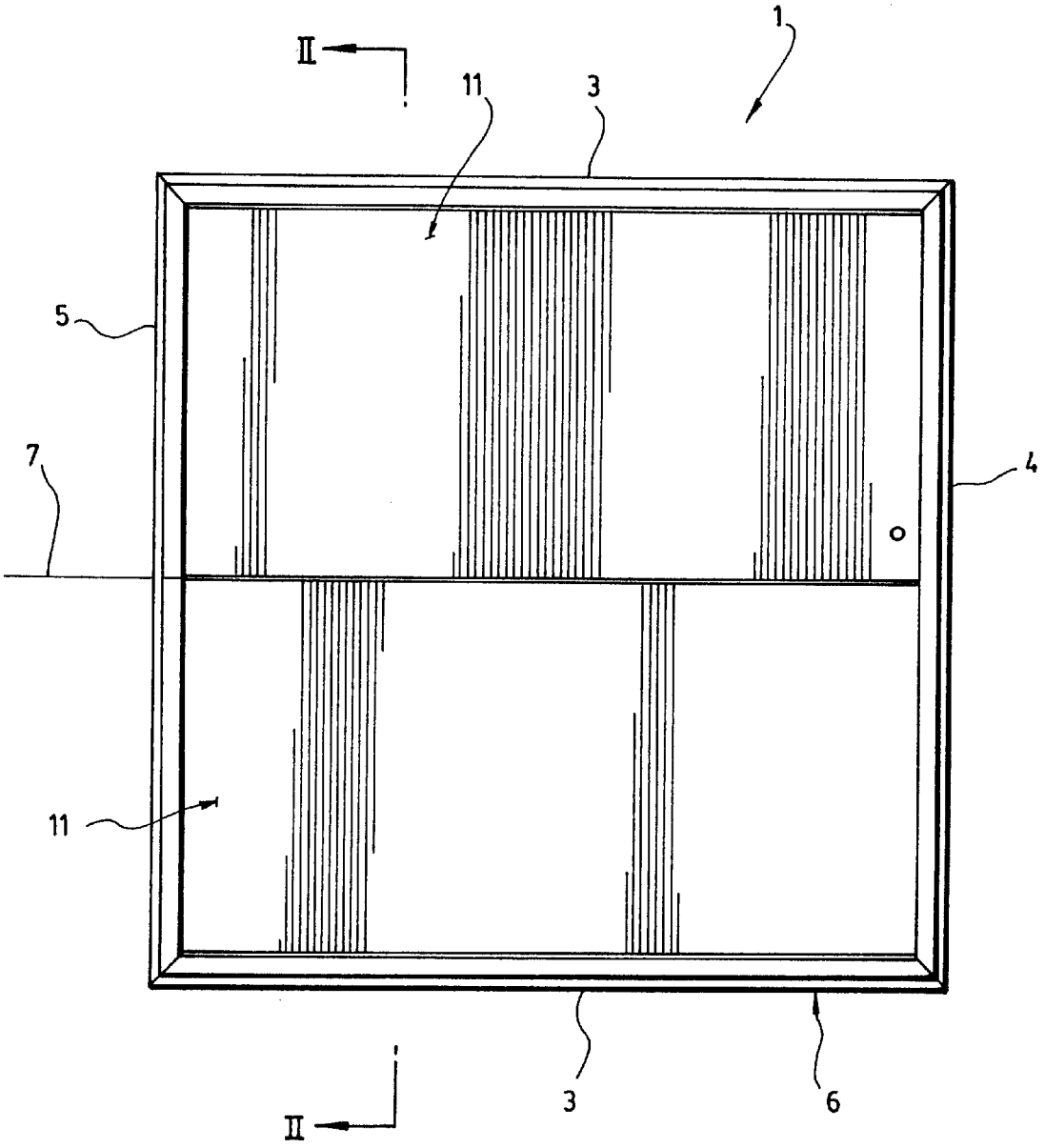
FIG. 1 is a top plan view of a floor hatch according to a first preferred embodiment of the invention, where the doors are in closed position.

The floor hatch 1 with an integrated security fence according to the invention has a frame 6 having a rectangular shape, as shown in FIG. 1, the frame having a longitudinal axis 7 and having two opposite edges 3 parallel to the axis, a front edge 4 and a rear edge 5 defining an opening having a length and a width, a top 8 and a bottom 9, where the opening lies in a plane parallel to a floor 2.

Figure 2:
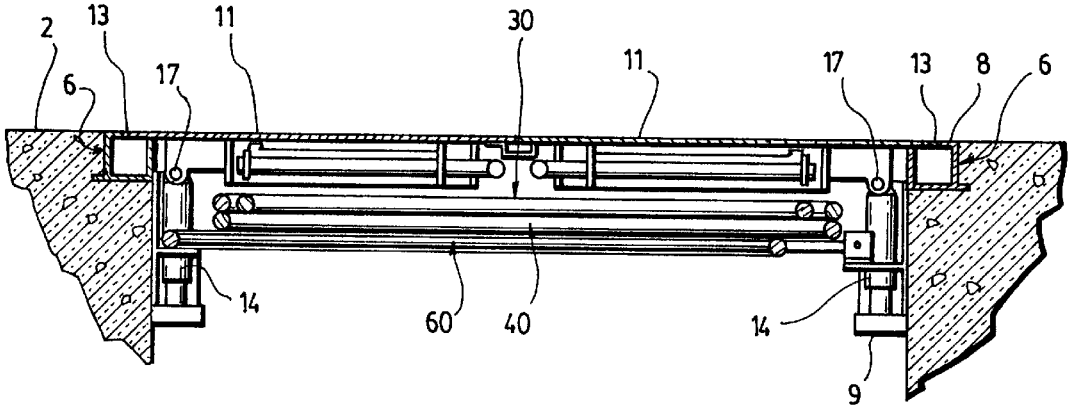
FIG. 2 is a cross-sectional view taken along line II—II of FIG. 1.
Figure 3:
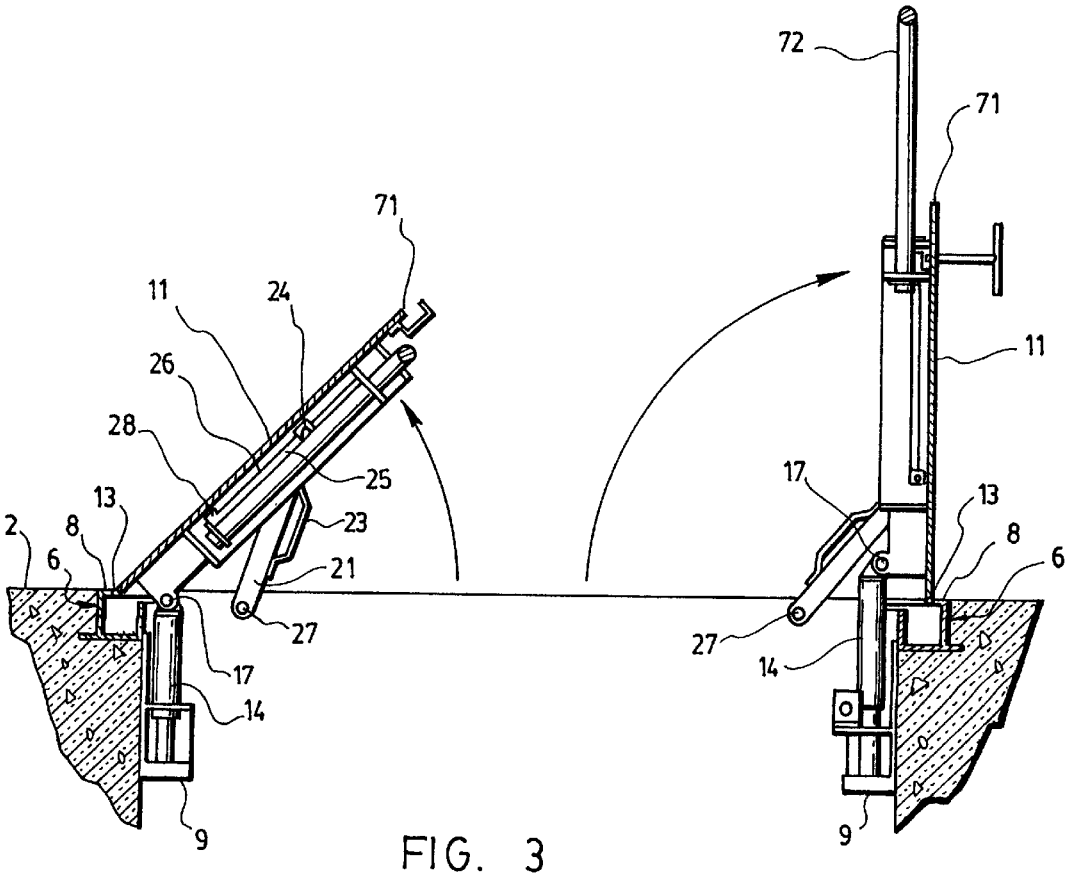
FIG. 3 is a cross-sectional view of the floor hatch of FIG. 1, showing opening of the doors.
Figure 7:
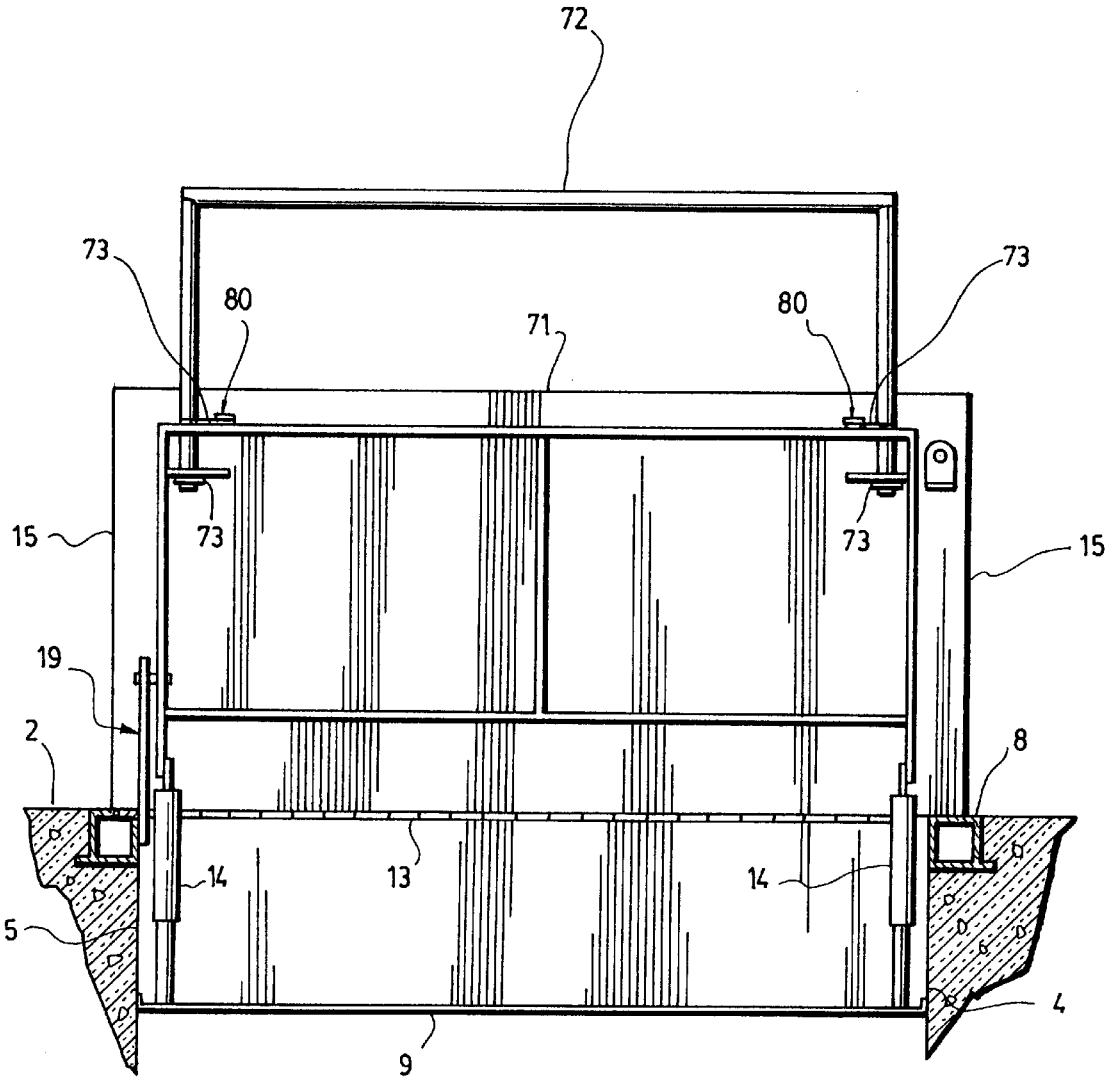
FIG. 7 is a cross-sectional view taken along line VII—VII of FIG. 5.

The floor hatch 1 further has a pair of pivoting doors 11 sized and shaped to at least cover the opening, as shown in FIG. 1, mounted on hinges 13, the hinges 13 lying parallel to the axis 7 along opposite edges 3 of the frame 6, as better shown on FIGS. 2 and 3. Advantageously, the doors 11 are mounted on piano hinges 13 (better shown on FIG. 7). The pivoting doors 11 pivot upwardly between a closed position, shown on FIGS. 1 and 2, and an open position (see the right-hand door 11 on FIG. 3). The closed position corresponds to when the doors 11 lie substantially parallel to the plane and block access to the opening, and the open position corresponds to when the doors 11 lie substantially perpendicular to the plane. When in the open position, the doors 11 form opposite sides of the security fence.

Means are provided for retaining the doors 11 in the open position. To that effect, each opposite side 15 of the pivoting doors 11 is provided with a telescoping hydraulic cylinder 14 to aid in the opening of the doors 11, mounted between the bottom 9 of the frame 6 and an appropriate pivot point 17 on the door 11. The telescoping cylinder 14 provides some resistance against the door 11 closing by itself. However, a slide-lock mechanism 19 is also provided at one of the opposite sides 15 of each door 11, preferably at the rear 5 of the frame 6 as shown on FIGS. 4 and 5.

The slide-lock mechanism 19 is comprised of a bar 21 having a handle 23 secured to the bar 21 and two opposite ends 25, 27. One of the opposite ends 25 is pivotably fastened to the rear edge 5 of the frame 6 at a predetermined distance inwardly from an adjacent opposite edge 3. The other opposite end 27 is provided with a cam 24 which slidably travels in a slot 26 fashioned in the door at the rear side thereof. The slot 26 is further provided with a hook 28 at a bottom end thereof and prevents the door 11 from closing when the cam 24 is engaged in the hook 28. In order to release the cam 24 from the hook 28, one pulls on the handle 23 which returns the cam 24 in the slot 26 so that the door 11 may be closed (see FIGS. 3 and 4). However, any other means to lock the doors in the open position are within the scope of the invention.

Figure 8:
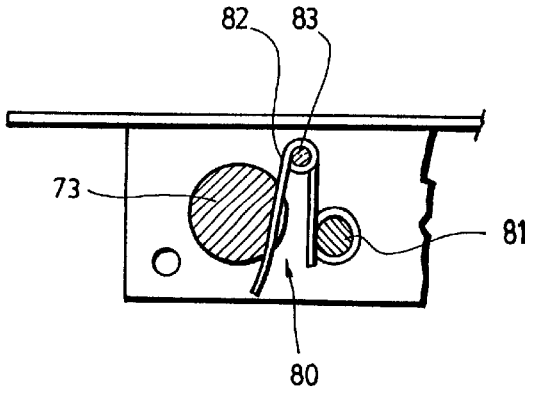
FIG. 8 is a top plan view of the retaining means of the telescopic extension for the pivotable doors.

Each door 11 preferably further has a top portion 71 opposite the hinges 13, the top portion 71 of each door 11 being provided with a telescopic extension 72. The telescopic extension 72 is preferably a downwardly U-shaped bar which slides in guides 73 of the door 11 (see FIG. 7). In order to retain the telescopic extension 72 in extended position (shown in FIG. 8), means 80 are provided. These means 80 include a peg 81, an outwardly biased spring 82 mounted about a first point 83 and tending to push against the U-shaped bar 72. The telescopic extension 72 is further provided with a transverse groove (not shown) at each of its legs 74 near the bottom extremity thereof. When the telescopic extension 72 is raised to the extended position, the transverse groove will be adjacent the spring 82 which will fit into the groove, thereby locking the telescopic extension 72 in position. In order to release the telescopic extension 72, an opposite pressure can be applied to the spring 82 to release it from the groove. Other means are equally acceptable for the purposes of the invention.

The floor hatch 1 according to the invention also has a first gate 30 pivotably mounted to the rear edge 5 on hinges 32, although there could be only one. The first gate 30 lies below the doors 11, as better shown on FIG. 2, and has a width smaller than the width of the opening. The first gate 30 is accessible when the doors 11 are in the open position, and pivots upwardly between a closed position when the first gate 30 is substantially parallel to the plane and blocks access to the opening and an open position where the gate 30 lies in a plane perpendicular to the plane and forms a rear side of the security fence (see FIG. 4). The first gate 30 has two opposite sides 31, each of the opposite sides 31 being provided with means 33 to secure the first gate 30 in the open position to a corresponding one of the door 11.

Figure 4:
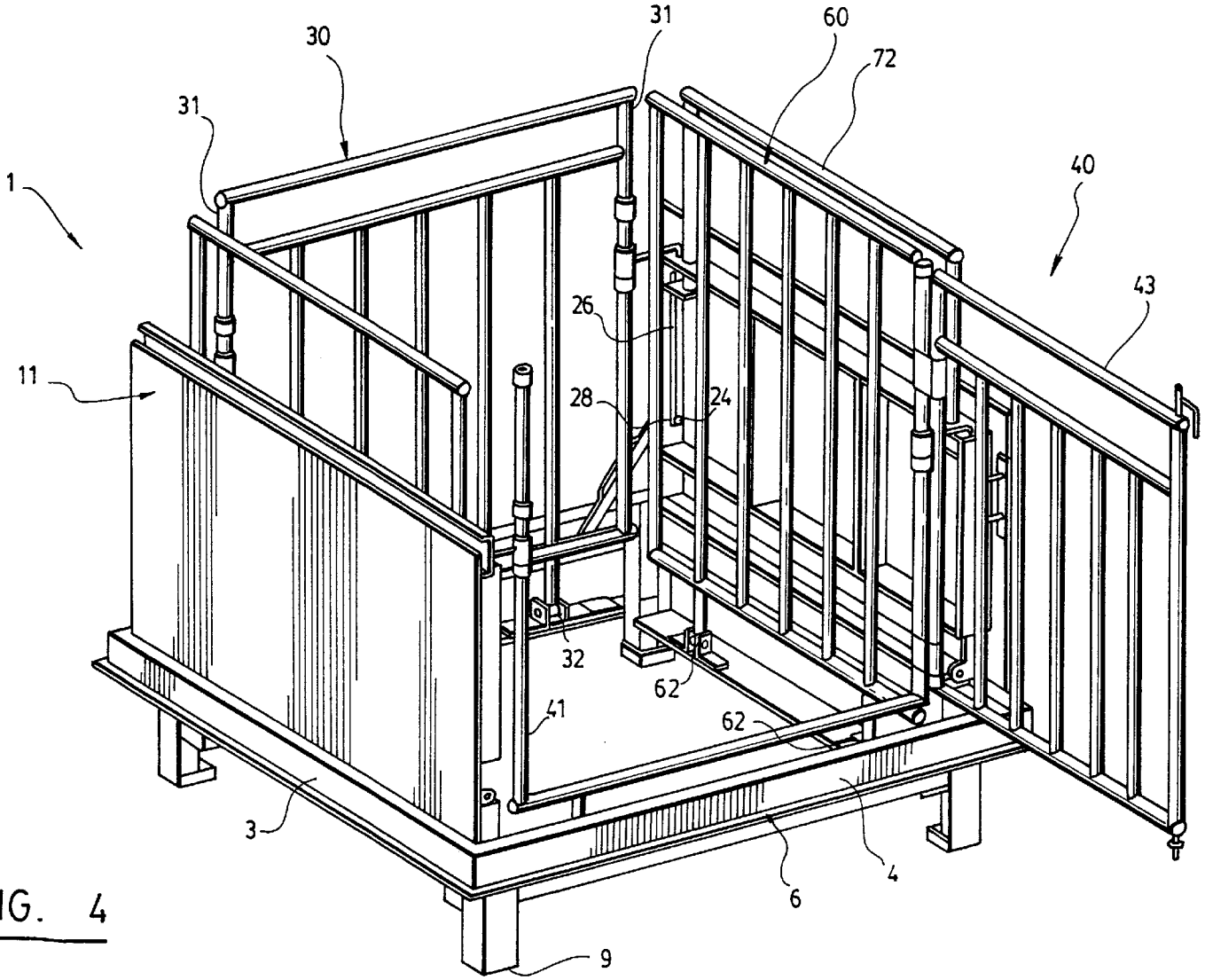
FIG. 4 is a front perspective view of the floor hatch of FIG. 1 in open position.
Figure 5:
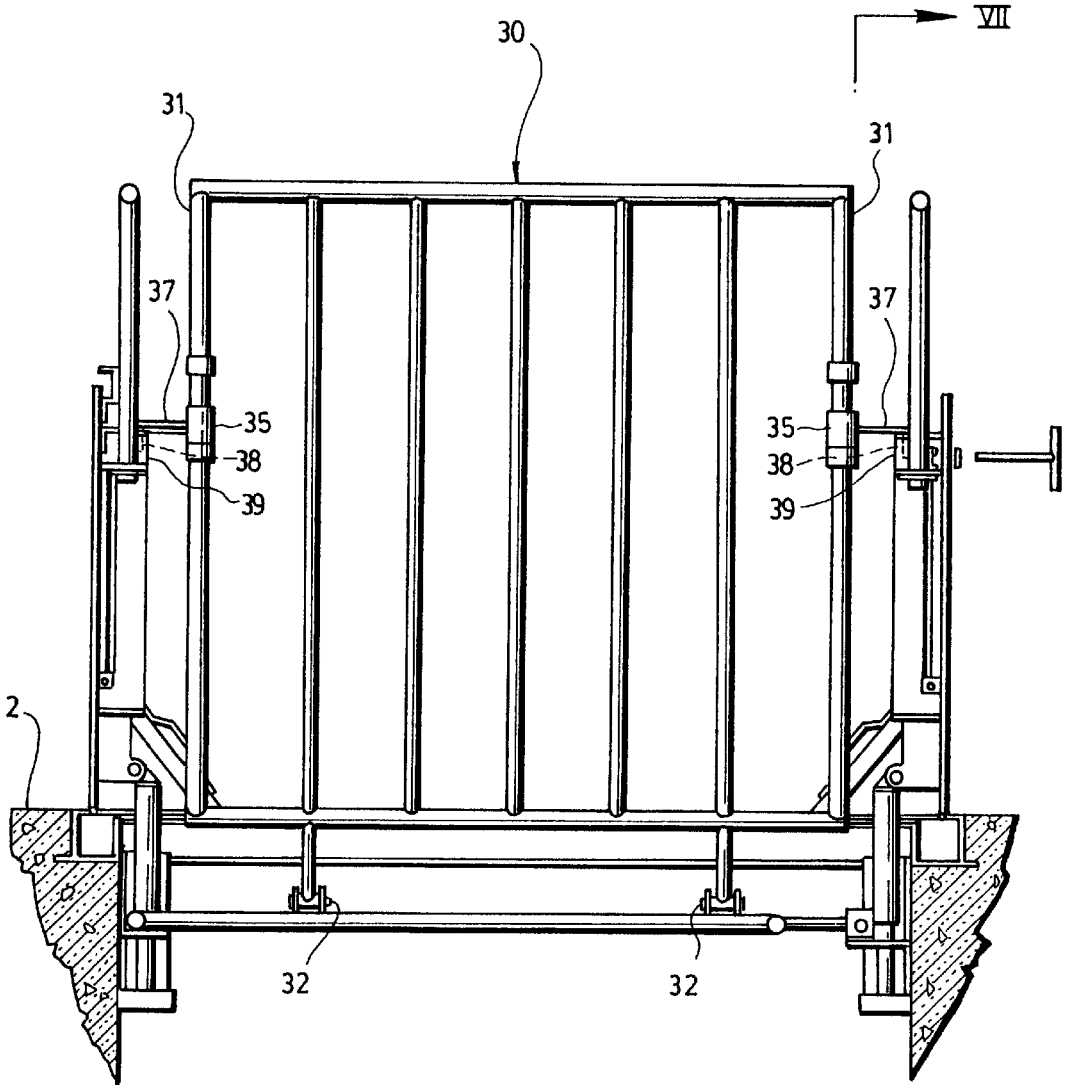
FIG. 5 is a cross-sectional view taken along line V—V of FIG. 4.

As better seen in FIGS. 4 and 5, these means 33 are preferably comprised of a collar 35 slidably mounted on a respective one of the opposite sides 31 of the first gate 30. The collar 35 is further provided an L-shaped extension 37 extending away from the collar 35. The L-shaped extension 37 has an end 38 designed to be inserted in a hole 39 provided on one of the opposite sides 15 of the door 11. In use, the collar 35 is slid upwardly a predetermined distance and rotated to align the end 38 with the hole 39 and then slid downwardly to insert the end 38 in the hole 39 and thus retain the first gate 30 in the open position.

The floor hatch 1 according to the invention as described above diminishes the security risk associated with an open hole in a floor in that access to the opening is permitted only through the front edge 4 of the frame 6. However, if the floor hatch 1 only includes the two pivoting doors 11 and the first gate 30, the front edge 4 of the floor hatch 1 would be open, which may be undesirable in some applications. Thus, the floor hatch 1 may further include a second gate 40.

The second gate 40 includes a support 41 and a pivoting barrier 43. The second gate 40 is pivotably mounted to the front edge 4 of the floor hatch 1 on hinges 42 although there could be only one and lies below the first gate 30, as shown in FIG. 2. The second gate 40 has a width smaller than the width of the opening and is accessible when the doors 11 and the first gate 30 are in the open position. The second gate 40 pivots upwardly between a closed position where the second gate is substantially parallel to the plane and blocks access to the opening and an open position, where the second gate lies in a plane substantially perpendicular to the plane and forms the front of the security fence (see FIG. 4).

Figure 6:
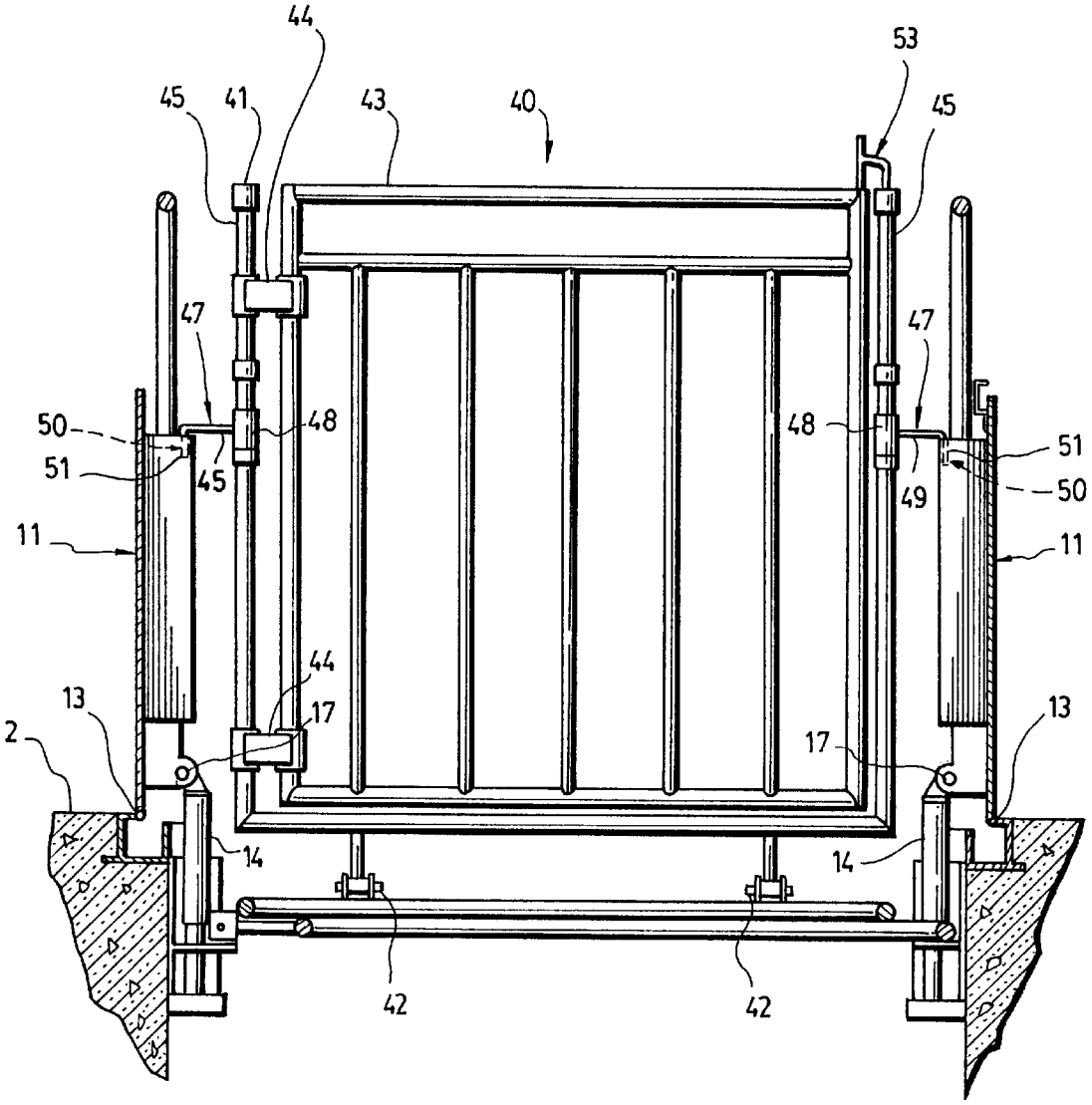
FIG. 6 is a side-elevational view of the front of the floor hatch showing the pivotable gate.

The support 41 has two opposite sides 45, each of the opposite sides 45 being provided with means 47 to secure the support 41 in the open position to a corresponding one of the doors 11. As shown in FIG. 6, the means 47 are preferably comprised of a collar 48 slidably mounted on a respective one of the opposite sides 45 of the support 41. The collar 48 is further provided with an L-shaped extension 49 extending away from the collar 48. The L-shaped extension 49 has an end 50 designed to be inserted in a hole 51 provided on one of the opposite sides 15 of the door 11, i.e. the front side. In use, the collar 48 is slid upwardly a predetermined distance and rotated to align the end 50 with the hole 51 and then slid downwardly to insert the end 50 in the hole 51 and thus retain the second gate 40 in the open position.

The pivoting barrier 43 of the second gate 40 is pivotably mounted to one of the opposite sides 45 of the support 41 through at least one hinge 44 and is sized and shaped to be within the support 41. The pivoting barrier 43 can pivot between a closed position, shown on FIG. 6, where the pivoting barrier 43 denies access to the opening, and an open position, shown in FIG. 4, where access to the opening is permitted through said support 41.

It should be understood that the pivoting barrier 43 can be mounted to either opposite side 45 of the support 41. FIG. 6 shows the pivoting barrier 43 mounted to the left-hand side.

The pivoting barrier 43 is preferably further provided with latch means 53 for latching the pivoting barrier 43 to the support 41 in the closed position. In the embodiment shown on FIG. 6, the latch means 53 includes a V-shaped hook which can be inserted in corresponding hooks of the support 41 and the pivoting barrier 43. However, any other type of latch means fulfills the object of the invention.

As an added security measure, the floor hatch may further include a security grate 60, pivotably mounted to one of the opposite side edges 3 of the floor hatch 1 on hinges 62, although there could be only one. The security grate 60 pivots between a closed position where the security grate lies substantially parallel to the first plane (FIG. 2) and an open position where the security grate is substantially perpendicular to the plane, adjacent one of the doors 11 (FIG. 4). Means 61 such as latch means are further provided to retain the security grate 60 in the open position. Any means 61 are acceptable to retain the security grate 60 in the open position.

It can thus be seen that the floor hatch 1 according to the invention has a built-in security fence. In order to have access to the opening, and thus the understructure of the floor 2, the doors 11 must be open. Afterwards, the first gate 30 must be opened. If the floor hatch 1 has a second gate 40, it also must be opened, thereby forming the four sides of the security fence. As well, if the floor hatch 1 has a security grate 60, it can only be accessed when the security fence is formed. Therefore, the problem of not using a security fence when opening a floor hatch 1 is obviated.

It should also be noted that conventional means to lock the doors 11 in the closed position, and thus prevent unauthorized access to the understructures can also easily be provided.

Figure 9:
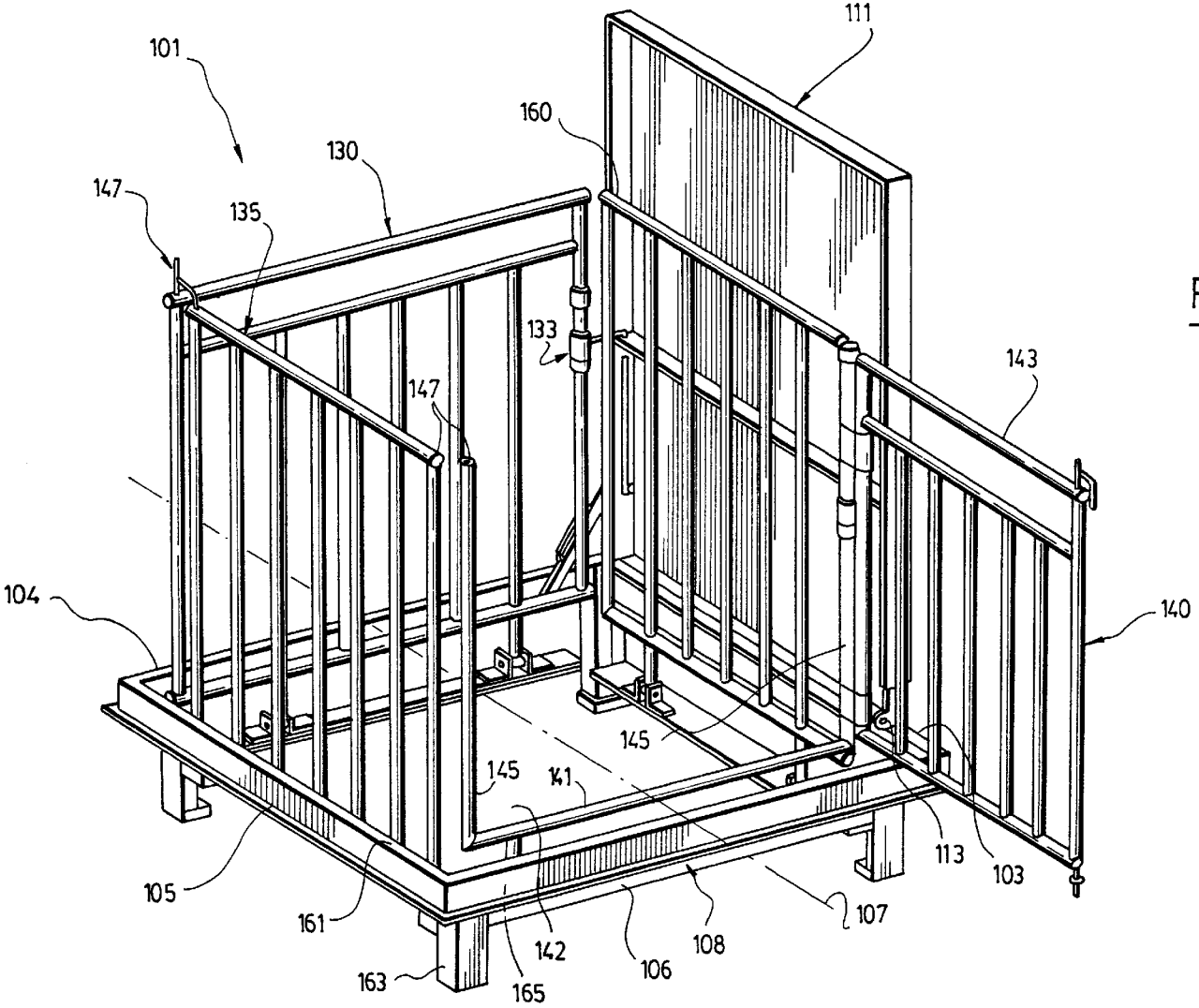
FIG. 9 is a front perspective view of a second preferred embodiment of the invention.

In a second preferred embodiment of the invention shown in FIG. 9, the floor hatch 101 according to the invention has a frame 108 having a rectangular shape with a longitudinal axis 107 and having first 103, second 104, third 105 and fourth 106 edges defining an opening 165 having an length and a width, a top 161 and a bottom 163 and lying in a plane parallel to a floor.

The floor hatch 101 also has a pivoting door 111, sized and shaped to at least cover the opening 165, the door 111 being pivotably mounted to the first edge 103 on a hinge 113 lying parallel to the first edge 103. The door 111 pivots upwardly between a closed position where the door 111 is substantially parallel to the plane and an open position where the door 111 is substantially perpendicular to the plane and forms a first side of the security fence.

The floor hatch 101 also has a first gate 130 pivotably mounted to the second edge 104 on hinges, lying below the door 111 and having a width smaller than the width of the opening 165, the first gate 130 being accessible when the door 111 is in the open position. The first gate 130 pivots upwardly between a closed position where the first gate 130 is substantially parallel to the plane and blocks access to the opening 165 and an open position where the first gate 130 lies substantially perpendicular to the plane and forms a second side of the security fence.

The first gate 130 is provided with means 133 to secure the first gate in the open position.

The floor hatch 101 also has a second gate 135 pivotably mounted to the third edge 105 on hinges, lying below the first gate 130 and having a width smaller than the width of the opening 165, the second gate 135 being accessible when the door 111 and the first gate 130 are in the open positions respectively. The second gate 135 pivots upwardly between a closed position where the second gate 135 is substantially parallel to the plane and blocks access to the opening 165 and an open position where the second gate 135 lies substantially perpendicular to the plane and forms a third side of the security fence.

The second gate 135 is provided with means 147 to secure the second gate in the open position.

Thus, when the door 111, the first gate 130 and the second gate 135 are in the closed positions, access to the opening 165 is denied, and when the door 111 is pivoted to the open position, the first gate 130 is pivoted to the open position and the second gate 135 is pivoted to the open position, access to the opening is permitted only through the fourth edge 106.

As in the first preferred embodiment of the invention, the floor hatch 101 may also include a third gate 140 comprising a support 141 and a pivoting barrier 143. The third gate 140 is pivotably mounted to the fourth edge 106 on hinges 142, and lies below the first 130 and second 135 gates. The third gate 140 has a width smaller than the width of the opening 165 and is accessible when the door 111, the first gate 130 and the second gate 135 are in the open positions respectively. The third gate 140 pivots upwardly between a closed position where the third gate 140 is substantially parallel to the plane and blocks access to the opening 165 and an open position where the third gate 140 is substantially perpendicular to the plane.

The support 141 of the third gate 140 has two opposite sides 145, each of the opposite sides 145 being provided with means 147 to secure the support 141 in the open position to a corresponding one of the door 111 or the first 130 or second gate 135. The pivoting barrier 143 is pivotably mounted to one of the opposite sides 145 of the support 141 and pivots between a closed position where the barrier 143 denies entry to the opening when the third gate 140 is in the open position and pivots outwardly to an open position where access to the opening 165 is permitted through the support 141.

Preferably, the barrier 143 of the third gate 140 is provided with latch means (not shown on FIG. 9 but similar to that shown on FIG. 6) for latching the pivoting barrier 143 to the support 141 in the closed position.

Again as in the first preferred embodiment, the floor hatch 101 may further comprise a security grate 160 pivotably mounted to one of the edges of the opening 165 proximal the bottom 163 thereof. The security grate 160 pivots upwardly between a closed position where the security grate 160 lies substantially parallel to the plane and an open position where the security grate 160 lies substantially perpendicular to the plane adjacent one of the doors. Means to secure said security grate in an open position to one of said door or one of said first and second gates are also provided.

It should be noted that the second preferred embodiment has been described in less detail than the first preferred embodiment and that is because the additional features described for the first preferred embodiment are equally applicable to the second preferred embodiment, i.e. the type of hinges, the means for securing the door and the gates together, and others. The second preferred embodiment has particularly been described to illustrate that the invention is not limited to two pivoting doors, but may also be realized with a single pivoting door covering the opening. As well, in the case of the second preferred embodiment, the first, second, third and fourth edges of the frame have no particular order since all that is essential for the invention is for at least three sides of the security fence to be raised, notwithstanding the orientation of the front, rear or side edges. Furthermore, the order of layering of the first, second or third grates when in closed positions respectively are not important.

The expressions "substantially parallel" and "substantially perpendicular" are used only to spatially identify orientation and should not be interpreted as being limitative to a particular angle or range of angles with respect to the plane. What is important is that when the floor hatch is in the closed position, the door or doors and gates are stacked one on top of the other within the frame, and when the floor hatch is in the open position, at least three sides of the security fence are raised.

Although the present invention has been explained hereinabove by way of a preferred embodiment thereof, it should be pointed out that any modifications to this preferred embodiment within the scope of the appended claims is not deemed to alter or change the nature and scope of the invention.

I claim:

1. A floor hatch with an integrated security fence, said floor hatch comprising:

a frame having a rectangular shape with a longitudinal axis, two opposite edges parallel to said axis, a front edge and a rear edge, said opposite edges, said front edge and said rear edge defining an opening having a length and a width, a top and a bottom, said opening lying in a plane parallel to a floor;

a pair of pivoting doors sized and shaped to at least cover said opening, said doors being mounted on hinges lying parallel to said axis along said opposite edges of said frame, said doors pivoting upwardly between a closed position where said doors are substantially parallel to said plane and block access to said opening and an open position where said doors are substantially perpendicular to said plane forming opposite sides of said security fence;

means for retaining said doors in said open position; and a first gate pivotably mounted to said rear edge on hinges, said first gate lying below said doors and having a width smaller than said width of said opening, said first gate being accessible when said doors are in said open position, said first gate pivoting upwardly between a closed position where said gate is substantially parallel to said plane and blocks access to said opening and an open position where said gate lies in a plane perpendicular to said plane and forms a rear side of said security fence, said first gate further having two opposite sides, each of said opposite sides being provided with means to secure said first gate in said open position to a corresponding one of said doors, whereby, when said first gate and said doors are in said closed position, access to said opening is denied, and when said doors are pivoted to said open position and, subsequently, when said first gate is pivoted to said open position, access to said opening is permitted only through said front edge of said frame.

2. A floor hatch with an integrated security fence according to claim 1, further comprising:

a second gate comprising a support and a pivoting barrier, said second gate being pivotably mounted to said front edge on hinges, lying below said first gate, said second gate having a width smaller than the width of said opening and being accessible when said doors and said first gate are in said open positions respectively, said second gate pivoting upwardly between a closed position where said gate is substantially parallel to said plane and blocks access to said opening and an open position where said gate is substantially perpendicular to said plane and forms a front side of said security fence, said support of said second gate having two opposite sides, each of said opposite sides being provided with means to secure said support in said open position to a corresponding one of said doors, wherein said pivoting barrier is pivotably mounted to one of said opposite sides of said support and pivoting between a closed position where said barrier denies entry to said opening when said second gate is in said open position and pivoting outwardly to an open position where access to said opening is permitted through said support; and said barrier of said second gate is provided with latch means for latching said pivoting barrier to said support in said closed position.

3. A floor hatch with an integrated security fence according to claim 2 further comprising:

a security grate pivotably mounted on hinges to one of said opposite edges of said opening proximal said bottom thereof, said security grate pivoting upwardly between a closed position where said security grate lies substantially parallel to said plane and an open position where said security grate lies substantially perpendicular to said plane adjacent one of said doors; and means to secure said security grate in an open position to one of said pivoting doors.

4. A floor hatch with an integrated security fence according to claim 2 wherein:

said pivoting doors each have a top portion opposite said hinges;

each top portion of said doors being further provided with a telescoping extension, said extension being telescoped upwardly when said doors are in said open position; and means for maintaining said extension in an upwardly telescoped position.

5. A floor hatch with an integrated security fence according to claim 2, wherein said floor hatch includes means to lock said pair of pivoting doors in said closed position.

6. A floor hatch with an integrated security fence according to claim 3, wherein said floor hatch includes means to lock said pair of pivoting doors in said closed position.

7. A floor hatch with an integrated security fence according to claim 4, wherein said floor hatch includes means to lock said pair of pivoting doors in said closed position.

8. A floor hatch with an integrated security fence according to claim 2, wherein said means for retaining said doors in said open position comprise:

a bar having a handle secured to said bar and two opposite ends, one of said opposite ends being pivotably fastened to said rear edge of said frame at a predetermined distance inwardly from an adjacent opposite edge, the other opposite end being provided with a cam which slidably travels in a slot fashioned in the corresponding door at the rear side thereof, the slot being further provided with a hook at a bottom end thereof preventing the door from closing when said cam is in said hook.

9. A floor hatch with an integrated security fence according to claim 3, wherein said means for retaining said doors in said open position comprise:

a bar having a handle secured to said bar and two opposite ends, one of said opposite ends being pivotably fastened to said rear edge of said frame at a predetermined distance inwardly from an adjacent opposite edge, the other opposite end being provided with a cam which slidably travels in a slot fashioned in the corresponding door at the rear side thereof, the slot being further provided with a hook at a bottom end thereof preventing the door from closing when said cam is in said hook.

10. A floor hatch with an integrated security fence according to claim 8, wherein said means to secure said first gate in said open position comprise a collar slidably mounted on a respective one of the opposite sides of said first gate, said collar being provided with an L-shaped extension extending away from said collar, said L-shaped extension having an end shaped and sized to be inserted in a hole provided on one of said rear side of said door.

11. A floor hatch with an integrated security fence according to claim 2, wherein:

said means to secure said second gate in said open position comprise a collar slidably mounted on each of said opposite sides of said support, said collar being provided with an L-shaped extension extending away from said collar, said L-shaped extension having an end shaped and sized to be inserted in a hole provided on one of said front side of said door.

12. A floor hatch with an integrated security fence, said floor hatch comprising:

a frame having a rectangular shape with a longitudinal axis having first, second, third and fourth edges and defining an opening, said opening having a length and a width and lying in a plane parallel to a floor;

a pivoting door, sized and shaped to at least cover said opening, said door being pivotably mounted to said first edge on a hinge, said door pivoting upwardly between a closed position where said door is substantially parallel to said plane and an open position where said door is substantially perpendicular to said plane and forms a first side of said security fence;

a first gate pivotably mounted to said second edge on hinges, lying below said door and having a width smaller than said width of said opening, said first gate being accessible when said door is in said open position, said first gate pivoting upwardly between a closed position where said first gate is substantially parallel to said plane and blocks access to said opening and an open position where said first gate lies substantially perpendicular to said plane and forms a second side of said security fence, said first gate being provided with means to secure said first gate in said open position; and a second gate pivotably mounted to said third edge on hinges, lying below said first gate and having a width smaller than said width of said opening, said second gate being accessible when said door and said first gate are in said open positions respectively, said second gate pivoting upwardly between a closed position where said second gate is substantially parallel to said plane and blocks access to said opening and an open position where said second gate lies substantially perpendicular to said plane and forms a third side of said security fence, said second gate being provided with means to secure said second gate in said open position;

whereby, when said door, said first gate and said second gate are in said closed positions, access to said opening is denied, and when said door is pivoted to said open position, said first gate is pivoted to said open position and said second gate is pivoted to said open position, access to said opening is permitted only through said fourth edge.

13. A floor hatch with an integrated security fence according to claim 12, further comprising:

a third gate comprising a support and a pivoting barrier, said third gate being pivotably mounted to said fourth edge on hinges, lying below said first and second gates, said third gate having a width smaller than the width of said opening and being accessible when said door, said first gate and said second gate are in said open positions respectively, said third gate pivoting upwardly between a closed position where said third gate is substantially parallel to said plane and blocks access to said opening and an open position where said third gate is substantially perpendicular to said plane, said support of said third gate having two opposite sides, each of said opposite sides being provided with means to secure said support in said open position to a corresponding one of said door or said first or second gate, wherein said pivoting barrier is pivotably mounted to one of said opposite sides of said support and pivoting between a closed position where said barrier denies entry to said opening when said third gate is in said open position and pivoting outwardly to an open position where access to said opening is permitted through said support; and said barrier of said second gate is provided with latch means for latching said pivoting barrier to said support in said closed position.

14. A floor hatch according to claim 12 further comprising:

a security grate pivotably mounted on a hinge to one of said edges of said opening proximal said bottom thereof, said security grate pivoting upwardly between a closed position where said security grate lies substantially parallel to said plane and an open position where said security grate lies substantially perpendicular to said plane adjacent one of said doors; and means to secure said security grate in an open position to one of said door or one of said first and second gates.

15. A floor hatch according to claim 13 further comprising:

a security grate pivotably mounted on a hinge to one of said edges of said opening proximal said bottom thereof, said security grate pivoting upwardly between a closed position where said security grate lies substantially parallel to said plane and an open position where said security grate lies substantially perpendicular to said plane adjacent one of said doors; and means to secure said security grate in an open position to one of said door or one of said first and second gates.

* * * * *